United States Patent [19]

Horie et al.

[11] Patent Number: 4,556,072

[45] Date of Patent: Dec. 3, 1985

[54] CIGARETTE REVERSING APPARATUS

[75] Inventors: Motonobu Horie; Minoru Suzuki; Shinji Ogura, all of Tokyo, Japan

[73] Assignee: The Japan Tobacco & Salt Public Corporation, Tokyo, Japan

[21] Appl. No.: 550,095

[22] Filed: Nov. 9, 1983

[30] Foreign Application Priority Data

Nov. 10, 1982 [JP] Japan ..... 57-196035

[51] Int. Cl.[4] ..... A24C 5/33

[52] U.S. Cl. ..... 131/282; 198/951

[58] Field of Search ..... 131/94, 95, 282; 198/951, 404, 403, 689

[56] References Cited

U.S. PATENT DOCUMENTS

| | | | |
|---|---|---|---|
| 3,176,825 | 4/1965 | Rudszinat | 198/951 |
| 3,625,103 | 12/1971 | Giatti | 198/951 |
| 3,696,910 | 10/1972 | Schmermund et al. | 198/951 |
| 3,887,065 | 6/1975 | Verjux | 198/404 |

*Primary Examiner*—V. Millin
*Assistant Examiner*—H. Macey

[57] ABSTRACT

A cigarette reversing apparatus with a rotating drum having radially extending slots of a width slightly larger than the diameter of a cigarette and of sufficient depth, each slot having at its opposing surfaces a pair of cigarette holding members spaced from each other a distance slightly smaller than the cigarette diameter, these pairs of cigarette holding members being arranged on the circumference of the drum. The cigarettes are fed onto the cigarette holding members and guide elements bring the longitudinal center of the cigarette to the circumference of the cigarette holding members; arcuate guide members provided along the outer circumference of the drum guide the free end of the cigarette so as to turn the cigarette about the point held by the cigarette holding members. A retrieving member takes out the cigarettes from the rotating drum.

7 Claims, 8 Drawing Figures

CIGARETTE REVERSING APPARATUS

BACKGROUND OF THE INVENTION

The present invention relates to an apparatus for reversing the direction of cigarettes and especially filter-tipped cigarettes.

Generally, filter-tipped cigarettes are manufactured by inserting a filter member of a two-cigarette-filter length between two cigarettes, wrapping a piece of paper applied with paste around the filter member and the ends of the cigarettes, and cutting the filter member at the center to obtain two filter-tipped cigarettes.

In this method of cigarette manufacture, two parallel rows of cigarettes are obtained, one row of cigarettes disposed opposite to the other row of cigarettes. Depending on the requirements from the cigarette storage device at a later stage of processing, it is a common practice to overturn one row of cigarettes so that they are oriented in the same direction as the cigarettes in the other row and then combine them into a single uniform line of cigarettes.

Apparatus is known for changing two lines of cigarettes, disposed in opposite directions, into a single line of cigarettes all oriented in the same direction.

The known equipment has a drum surface cut with a plurality of slots and includes a guide member whereby the cigarettes are made to rise outwardly and stand on one end so as to be perpendicular to the drum axis and then is turned over to make a 180-degree turn.

In this equipment, while the cigarette is being turned, the gravity center of the cigarette moves outwardly, which in turn increases the centrifugal force urging the cigarettes to move outwardly. This somewhat prevents smooth overturning of cigarettes. This tendency has become notable in recent years as the speed of the cigarette making machines increases.

SUMMARY OF THE INVENTION

In view of the above problem it is the object of this invention to provide a device which reverses the cigarettes about the gravity center.

The cigarette reversing apparatus of this invention is characterized in consisting of: a rotating drum having radially extending slots with their width slightly larger than the diameter of cigarette and with sufficient depth, each slot having at its opposing inner surfaces a pair of cigarette center holding members spaced from each other a distance slightly smaller than the cigarette diameter, these pairs of cigarette holding members being arranged on a circumference of the drum; a means for feeding the cigarettes onto the cigarette holding members, the means including a guide means to bring the longitudinal center of the cigarette to the circumference of the holding members; cigarette reversing means provided along the outer circumference of the drum so as to guide the free end of the cigarette to turn the cigarette about the point held by the holding members; and a retrieving member to take out the cigarettes from the rotating drum.

It is possible to add to the equipment of this invention adequate means to make the equipment suitable for high speed rotation. This invention provides a cigarette reversing apparatus which also is equipped with an inlet guide member and an outlet guide member, the inlet guide member being installed at the cigarette receiving portion on the drum to feed the cigarette to the cigarette center holding members, the outlet guide member being adapted to retrieve the reversed cigarettes from the cigarette center holding members.

Further, this invention provides a cigarette reversing apparatus in which each pair of opposing cigarette center holding members has at opposing ends an air suction hole connected to a vacuum source.

According to this invention, the longitudinal center or the gravity center of the cigarette are held when being turned over, thereby preventing an increase in centrifugal force resulting from the shift in the location of the gravitational center during the cigarette rotating action, to ensure smooth turning of a cigarette with an apparatus with a simple structure.

DETAILED DESCRIPTION OF THE EMBODIMENTS

Now, this invention will be explained taking one example embodiment of this invention with reference to the attached drawings.

Figure 1:
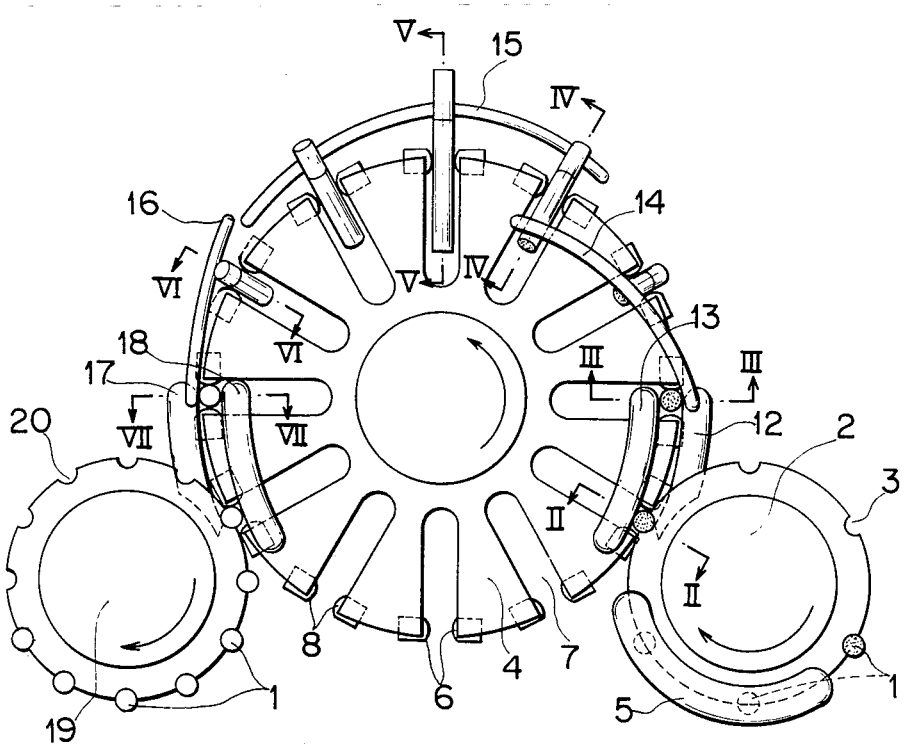
FIG. 1 is a front view of the cigarette reversing apparatus of this invention.

FIG. 1 is the front view of the apparatus of this invention.

In the cigarette making machine having this apparatus, a cigarette bar of two-cigarette length with a filter member inserted in the center is manufactured and this cigarette bar is cut at the center to form two separate cigarettes disposed in opposite directions. A number of these cigarettes form two parallel rows which extend in the direction perpendicular to the length of the cigarettes. They are then transferred to the succeeding work stages. While being transferred, the cigarettes in one row are turned over so that they face in the same direction as those in the other row. Then two rows are brought together to form a single, uniform row. FIG. 1 shows an apparatus for reversing one row of cigarettes.

The cigarettes 1 are put in a plurality of recesses 3 formed around a feed drum 2 in the circumference thereof and carried to a rotating drum 4. Said drum 4 is generally defined by a periphery and first and second axial ends and has an axial thickness smaller than the length of a single cigarette. Provided along a part of the circumference of the feed drum 2 is a guide plate 5 which keeps constant the transfer position of cigarettes from the recesses 3 to the rotating drum 4. The constant cigarette transfer position helps define the position where the cigarettes are held by a cigarette holding member 6 described later.

The recesses 3 of the feed drum 2 move in synchronism with slots 7 of the rotating drum 4 such that said recesses 3 and slots 7 meet at a predetermined position and the cigarettes 1 are transferred from the feed drum 2 to the rotating drum 4 at said predetermined position which acts as the receiving position.

The rotating drum 4 has parallel slots 7 aligned in the direction of a rotating axis to extend in radial and axial directions and continuously open at the periphery and the two axial ends. The slots 7 are slightly wider than the diameter of the cigarette 1 and also deep enough to allow the cigarette 1 held by the cigarette holding member 6 to be turned.

The cigarette holding members 6 are attached to the axially central portion of opposing inner walls of the slots 7 adjacent to the periphery of the rotating drum with a gap in between. The opposing surfaces of the inner walls are each formed into a semispherical surface 8 to ensure smooth advance and retraction of the cigarettes 1. The semispherical surfaces of the cigarette holding member 6 are suitable as the center of rotation of the cigarette and the distance between the pair of opposing semispherical surfaces is slightly smaller than the diameter of cigarette so that the cigarette can be held between them.

Figure 8:
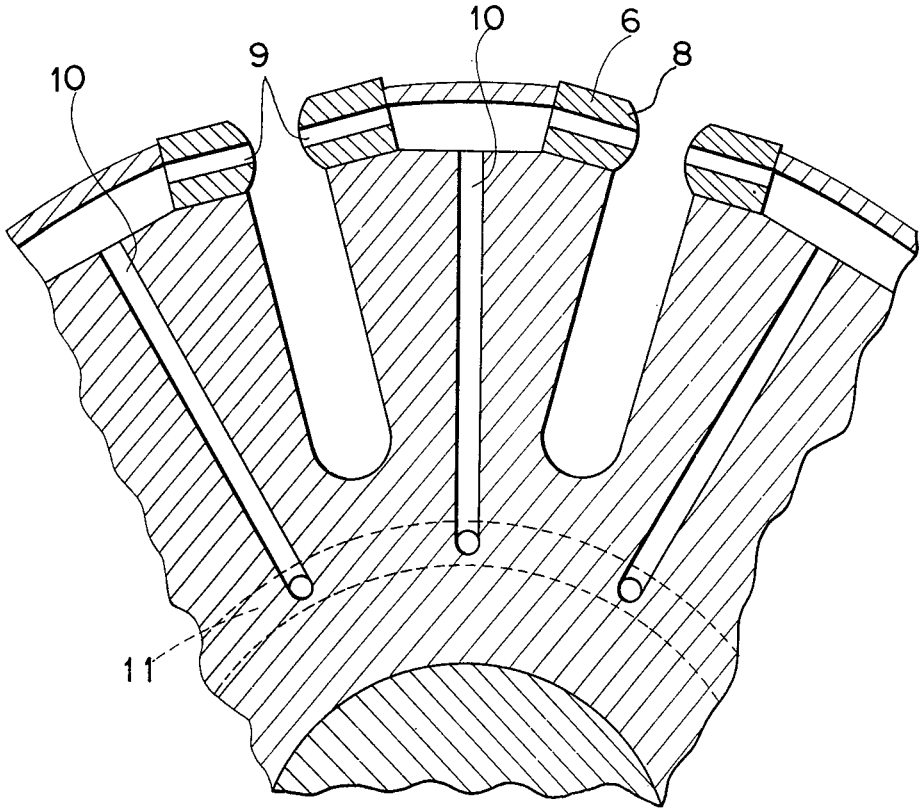
FIG. 8 is a partial cross-sectional view of the reversing apparatus showing the cigarette holding members formed with air suction holes.

As shown in FIG. 8, the cigarette holding members 6 can be provided with an air suction hole 9. The hole provided at the end of the semispherical surface 8 of the holding member 6 is connected to a vacuum source (not shown) through an air passage 10 formed in the rotating drum 4. Since the air suction acts in the area where the cigarette 1 is turned in the rotating drum 4, a known distributing valve may be used which has an air groove 11 to distribute air to the working sections ranging from the receiving portion to the retrieving portion.

The cigarette receiving portion is provided with first outer arcuate guide members 12 and first inner arcuate guide members 13 which are supported by a frame (not shown).

Figure 2:
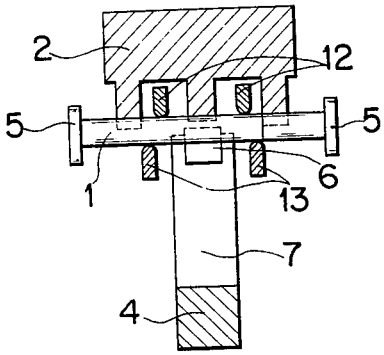
FIGS. 2 through 7 are partial cross-sectional views taken along the lines II—II to VII—VII of FIG. 1.

The inner arcuate guide members 13 and the outer arcuate guide members 12 are slightly inclined radially inwardly along the respective first and second axial ends of the rotating drum 4 at peripheral portions thereof, thus defining arcuate guide spaces having an inlet end and outlet end to trap the cigarette in the recess at said predetermined position and to guide the cigarette 1 out of the recess 3 into the slot 7 at said outlet position along the opposing surfaces of the guides spaced from each other a distance equal to the size of cigarette 1 (see FIG. 2). At the outlet end of the inner and outer arcuate guide members 12 and 13, the cigarette 1 is held by the cigarette holding members 6 in axial orientation with the diametrical portion of the cigarette 1 being aligned with the ends of the semispherical surface 8 of the cigarette holding members 6, the semispherical surface ends defining the narrow gap or neck for the cigarette to be held (see FIG. 3).

There is provided opposite the first axial end of the rotating drum 4 a first elongated guide member 14 supported on the frame (not shown) and having first and second end portions. Said first elongated guide member 14 extends from the outer arcuate guide member 12 toward the rotating drum 4 increasingly axially inwardly. Said first end portion of the first elongated guide member 14 is positioned in the vicinity of the first outer arcuate guide member 12. There is provided radially outside the rotating drum a second elongated guide member 15 supported on the frame (not shown) and having first and second end portions. Said second elongated guide 15 extends from a second axial end side of the rotating drum 4 to a first axial end side of the rotating drum 4 such that said first end portion of the second guide member 15 holds the cigarette in cooperation with the second end portion of the first elongated guide member 14 symmetrically with respect to the longitudinal center of the cigarette. There is provided a third elongated guide member 16 supported by the frame (not shown) on a first axial end side of the rotating drum 4 substantially parallel to the first axial end of the rotating drum and in the vicinity of the periphery thereof. Said third elongated guide member 16 has first and second end portions. Said first end portion of the third elongated guide member 16 is located in the vicinity of the second end of the second elongated guide member 15. The third elongated guide member 16 extends increasingly radially inwardly towards its second end portion.

Figure 5:
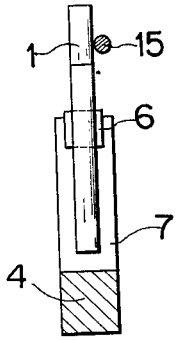
Figure 3:
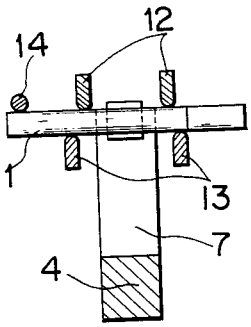
Figure 6:
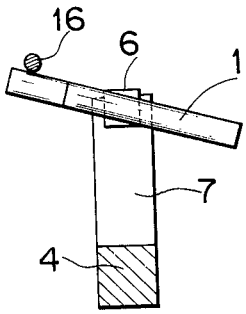
Figure 4:
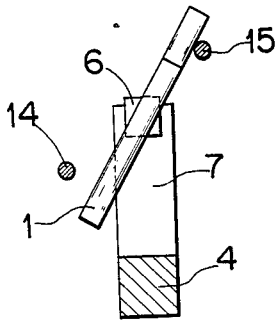
Figure 7:
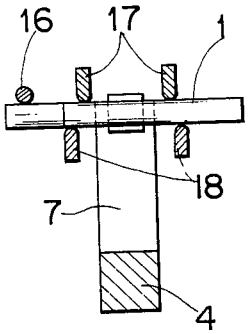

Preferably, the first, second, and third elongated guide members 14, 15, and 16 are arcuated toward the drum 4 and provided near the circumference of the rotating drum 4 over the length where the cigarette 1 is turned. The first elongated guide member 14 pushes down one end of the cigarette 1 (as shown in FIG. 3), the second elongated guide member 15 pushes up the other end of cigarette (as shown in FIG. 4), gradually brings it upright (as shown in FIG. 5) and then gradually pushes it down to continue the rotation of cigarette, then the third elongated guide member 16 pushes the cigarette down until it is in axial orientation (as shown in FIG. 6 and 7) with respect to the rotating drum 4. The cigarette 1 thus turned 180-degrees is taken out from the rotating drum 4 at the takeout portion.

At the takeout portion, second outer and inner arcuate guide members 17 and 18 are provided in association with the path of the reversed cigarettes and supported by the frame.

The second outer arcuate guide members 17 and second inner arcuate guide members 18 guide the cigarette 1 along their opposing surfaces spaced from each other a distance equal to the size of cigarette. The guiding of the cigarette is performed to take the cigarette out of the cigarette holding members 6 and guide it toward the outer edge of the slot 7 along the slightly outwardly inclined surface (as shown in FIG. 7).

The takeout drum 19 takes out the overturned cigarettes 1 by accommodating them in the recesses 20 formed on the outer surface thereof. The means for taking out the cigarettes is not limited to the drum 19 shown and it is possible to use suitable devices for transferring the cigarettes in lateral direction.

Further, in the above cigarette takeout and transfer device, two lines of cigarettes can be brought into a single line by using additional guides in a way widely applied. That is, in common cigarette making machines, two parallel lines of cigarettes, one line of cigarettes to be overturned and one line of cigarettes not overturned, are moved in the direction perpendicular to the length of cigarette. The inverted cigarettes are, for example, transferred one by one onto every other slot provided in the above transfer apparatus and the remaining alternate slots receive the uninverted cigarettes from the transfer means not shown. Then the end positions of the two lines of cigarettes can be aligned with each other by the guide means.

As described above, according to this invention, the cigarettes are held at the longitudinal center or at the properly determined gravity center and turned over. The cigarette center holding members have semispherical surfaces to prevent scoring of the diametrical portion of the cigarette and make use of a vacuum in holding the cigarette as required. In this way, the construction of the cigarette reversing apparatus according to this invention permits high speed operation.

What is claimed is:

1. A cigarette reversing apparatus comprising a rotating drum generally defined by a periphery and first and second axial ends, said rotating drum having an axial thickness smaller than a cigarette length, said rotating drum having a plurality of slots extending in radial and axial directions and continuously open at the periphery and the first and second axial ends, each slot having cigarette holding means provided at an axially central portion adjacent to the periphery for holding a cigarette at a longitudinal center thereof, each slot defining a sufficient space to allow rotation of the cigarette about said longitudinal center;

cigarette feeding means for supplying a cigarette to each cigarette holding means such that the cigarette is held by the cigarette holding means at said longitudinal center in axial orientation;

cigarette end guide means for reversing said cigarette held in axial orientation by guiding two free end portions thereof for 180-degree rotation; and retrieving means for taking out the reversed cigarettes from said slots one by one.

2. A cigarette reversing apparatus according to claim 1, wherein said cigarette holding means includes a pair of cigarette holding members attached to opposing inner surfaces of said slot adjacent to the periphery of the rotating drum, said cigarette holding members having substantially semispherical surfaces which face each other across a gap therebetween, each semispherical surface having an air suction hole for connection to a vacuum source.

3. A cigarette reversing apparatus according to claim 2, wherein said cigarette feeding means includes: a feed drum having a plurality of recesses therearound to receive cigarettes at the same intervals as those of said slots of the rotating drum and adapted to rotate in synchronism therewith such that said slots and said recesses meet at a predetermined point; said feeding means also including first cigarette guide means for guiding a cigarette in each recess at said predetermined point to said gap.

4. A cigarette reversing apparatus according to claim 3, wherein said first cigarette guide means includes, adjacent said cigarette feeding means, a pair of inner arcuate guide members and also a pair of outer arcuate guide members arranged substantially along the respective first and second axial ends of the rotating drum at peripheral portions thereof but extending increasingly radially inwardly to define an arcuate guide space having an inlet end at said predetermined point and an outlet end at a slightly radially inner position than said predetermined position, said guide space being adapted to trap the cigarette in the recess at said predetermined point and guide the same into the gap of the opposing slot during rotation of the rotating drum.

5. A cigarette reversing apparatus according to claim 4, wherein said cigarette end guide means includes a first elongated guide member provided adjacent said first axial end of the rotating drum, said first elongated guide member having first and second end portions and extending on said first axial end side of the rotating drum from said outer arcuate guide member toward the rotating drum increasingly axially and radially inwardly, said first end portion of the first elongated guide member being in the vicinity of the outer arcuate guide member, a second elongated guide member having first and second end portions and provided radially outside the rotating drum, said second elongated guide member extending from said second axial end side of the rotating drum toward said first axial end side of the rotating drum, said first end portion of the second guide member holding the cigarette in cooperation with the second end portion of the first elongated guide member symmetrically with respect to the longitudinal center of the cigarette, and a third elongated guide member provided on said first axial end side of the rotating drum substantially parallel to the first axial end of the rotating drum and in the vicinity of the periphery thereof, said third elongated guide member having first and second end portions, said first end portion of the third elongated guide member being in the vicinity of the second end of the second elongated guide member, and said third elongated guide member extending increasingly radially inwardly from said first end portion towards said second end portion thereof.

6. A cigarette reversing apparatus according to claim 1, wherein said retrieving means includes a take out drum having a plurality of recesses therearound at same intervals as the slots of the rotating drum and adapted to rotate in synchronism with the rotating drum.

7. A cigarette reversing apparatus according to claim 6, further including second cigarette guide means for guiding the cigarette in each slot to each recess of the take out drum.

* * * * *